US008720722B2

(12) United States Patent
Sunday et al.

(10) Patent No.: US 8,720,722 B2
(45) Date of Patent: May 13, 2014

(54) VENTING MECHANISM FOR CONTAINERS

(75) Inventors: Matthew Brian Sunday, DeMossville, KY (US); Michael Jeffrey Fisher, Springboro, OH (US)

(73) Assignee: Cornerstone Research Group, Inc., Dayton, OH (US)

( * ) Notice: Subject to any disclaimer, the term of this patent is extended or adjusted under 35 U.S.C. 154(b) by 814 days.

(21) Appl. No.: 12/888,829

(22) Filed: Sep. 23, 2010

(65) Prior Publication Data

US 2012/0181294 A1 Jul. 19, 2012

Related U.S. Application Data

(63) Continuation of application No. 12/526,360, filed as application No. PCT/US2008/056031 on Mar. 6, 2008, now Pat. No. 8,356,727, which is a continuation-in-part of application No. 11/611,358, filed on Dec. 15, 2006, now abandoned.

(60) Provisional application No. 60/893,499, filed on Mar. 7, 2007, provisional application No. 60/750,500, filed on Dec. 15, 2005.

(51) Int. Cl.

| | |
|---|---|
| ***B65D 51/00*** | (2006.01) |
| ***B65D 51/16*** | (2006.01) |
| ***F16J 13/00*** | (2006.01) |
| ***F16J 15/00*** | (2006.01) |
| ***B65D 90/34*** | (2006.01) |

(52) U.S. Cl.

CPC ..... *B65D 51/16* (2013.01); *B65D 90/34* (2013.01)

USPC ..... 220/202; 220/745; 102/481; 102/377; 137/67; 137/72; 60/223

(58) Field of Classification Search

USPC ..... 220/745; 102/481, 377; 251/129.06; 60/223

See application file for complete search history.

(56) References Cited

U.S. PATENT DOCUMENTS

| | | | | |
|---|---|---|---|---|
| 2,125,419 | A * | 8/1938 | Birk | 206/1.5 |
| 2,717,437 | A | 9/1955 | DeMestral | |
| 2,958,185 | A * | 11/1960 | Sanders | 60/223 |
| 3,295,324 | A * | 1/1967 | Conard et al. | 60/254 |
| 3,613,732 | A * | 10/1971 | Willson et al. | 137/625.44 |
| 3,783,429 | A * | 1/1974 | Otte | 337/393 |
| 4,430,392 | A * | 2/1984 | Kelley et al. | 429/53 |
| 4,489,883 | A * | 12/1984 | Anderson | 236/92 C |
| 4,596,483 | A * | 6/1986 | Gabriel | 403/28 |
| 4,642,254 | A * | 2/1987 | Walker | 428/35.1 |
| 4,660,714 | A * | 4/1987 | Suzuki et al. | 206/0.6 |

(Continued)

FOREIGN PATENT DOCUMENTS

| | | |
|---|---|---|
| WO | WO 2005/116573 A1 | 8/2005 |
| WO | PCT/US2005/015685 A1 | 11/2005 |

*Primary Examiner* — Robert J Hicks
*Assistant Examiner* — Gideon Weinerth
(74) *Attorney, Agent, or Firm* — Dinsmore & Shohl LLP

(57) ABSTRACT

The presently disclosed device provides a method and means for ensuring that containers of all types and sizes are vented or purged to atmospheric or environmental conditions upon the interior or exterior of the container reaching a critical temperature pressure, or humidity. Specifically, the presently disclosed invention integrates shape memory polymer (SMP) based, thermally activated fasteners into the venting systems. The result is a venting system that increases munitions safety without compromising the venting effectiveness, structural integrity, or the required bullet/fragment impact resistance requirements of the system.

17 Claims, 5 Drawing Sheets

(56) References Cited

U.S. PATENT DOCUMENTS

| | | | | |
|---|---|---|---|---|
| 4,831,094 | A | 5/1989 | Stein et al. | |
| 4,848,653 | A * | 7/1989 | Van Becelaere | 236/49.3 |
| 4,887,430 | A * | 12/1989 | Kroll et al. | 60/527 |
| 5,042,677 | A * | 8/1991 | Chen et al. | 220/201 |
| 5,044,154 | A * | 9/1991 | English et al. | 60/223 |
| 5,120,175 | A * | 6/1992 | Arbegast et al. | 411/501 |
| 5,160,233 | A * | 11/1992 | McKinnis | 411/433 |
| 5,248,233 | A * | 9/1993 | Webster | 411/433 |
| 5,487,484 | A * | 1/1996 | Bonniau et al. | 220/201 |
| 5,687,995 | A * | 11/1997 | Mori et al. | 285/381.2 |
| 5,722,709 | A * | 3/1998 | Lortz et al. | 294/86.4 |
| 5,735,114 | A * | 4/1998 | Ellingsen | 60/39.1 |
| 5,856,022 | A | 1/1999 | McCormick et al. | |
| 6,076,467 | A * | 6/2000 | Cespedosa et al. | 102/378 |
| 6,086,599 | A | 7/2000 | Lee | |
| 6,126,371 | A * | 10/2000 | McCloskey | 411/82.5 |
| 6,321,656 | B1 | 11/2001 | Johnson | |
| 6,338,242 | B1 | 1/2002 | Kim et al. | |
| 6,360,526 | B2 | 3/2002 | Kunstmann | |
| 6,363,855 | B1 | 4/2002 | Kim et al. | |
| 6,499,700 | B1 * | 12/2002 | Schlosser et al. | 244/158.1 |
| 6,546,602 | B1 * | 4/2003 | Eipper et al. | 24/442 |
| 6,585,442 | B2 * | 7/2003 | Brei et al. | 403/13 |
| 6,759,481 | B2 | 7/2004 | Tong | |
| 6,920,675 | B2 | 7/2005 | Brown et al. | |
| 7,013,536 | B2 | 3/2006 | Golden et al. | |
| 7,217,059 | B1 * | 5/2007 | Rudduck | 403/324 |
| 7,308,738 | B2 * | 12/2007 | Barvosa-Carter et al. | 24/442 |
| 7,373,885 | B2 | 5/2008 | Skinner | |
| 7,549,375 | B2 * | 6/2009 | Cook et al. | 102/377 |
| 7,600,301 | B2 * | 10/2009 | Rudduck et al. | 24/606 |
| 7,610,783 | B2 * | 11/2009 | Rudduck et al. | 70/277 |
| 7,662,506 | B2 * | 2/2010 | Jeon | 429/53 |
| 8,082,846 | B2 * | 12/2011 | Cook et al. | 102/377 |
| 8,096,034 | B2 * | 1/2012 | Barvosa-Carter et al. | 29/419.1 |
| 8,221,043 | B2 * | 7/2012 | Guyton | 411/511 |
| 8,297,192 | B2 * | 10/2012 | Hays et al. | 102/481 |
| 8,356,727 | B2 * | 1/2013 | Traxler et al. | 220/745 |
| 8,381,656 | B1 * | 2/2013 | Woo et al. | 102/481 |
| 8,408,136 | B1 * | 4/2013 | Lee | 102/377 |
| 8,414,366 | B2 * | 4/2013 | Browne et al. | 454/162 |
| 8,418,455 | B2 * | 4/2013 | Lyman et al. | 60/529 |
| 8,578,855 | B2 * | 11/2013 | Diehl et al. | 102/377 |
| 8,596,291 | B2 * | 12/2013 | Kotefski et al. | 137/72 |
| 2001/0035005 | A1 | 11/2001 | Kunstmann | |
| 2002/0040949 | A1 * | 4/2002 | Brei et al. | 244/158 R |
| 2002/0062547 | A1 * | 5/2002 | Chiodo et al. | 29/426.5 |
| 2004/0244358 | A1 * | 12/2004 | Prytz | 60/223 |
| 2005/0199845 | A1 * | 9/2005 | Jones et al. | 251/129.06 |
| 2006/0005986 | A1 * | 1/2006 | Alcoe | 174/52.1 |
| 2006/0012191 | A1 * | 1/2006 | Brei et al. | 292/341.17 |
| 2006/0137742 | A1 * | 6/2006 | Smith et al. | 137/68.13 |
| 2006/0202512 | A1 * | 9/2006 | Brei et al. | 296/187.04 |
| 2006/0207460 | A1 | 9/2006 | Reed | |
| 2006/0243153 | A1 | 11/2006 | Skinner et al. | |
| 2006/0254452 | A1 | 11/2006 | Hunn et al. | |
| 2007/0095239 | A1 | 5/2007 | Skinner | |
| 2007/0240600 | A1 | 10/2007 | Skinner et al. | |
| 2009/0013506 | A1 * | 1/2009 | Mizuhara et al. | 24/442 |
| 2009/0211648 | A1 * | 8/2009 | Spinelli et al. | 137/79 |
| 2010/0126887 | A1 * | 5/2010 | Kaddour et al. | 206/216 |
| 2010/0330894 | A1 * | 12/2010 | Alexander et al. | 454/70 |
| 2011/0232562 | A1 * | 9/2011 | Koehler et al. | 116/216 |
| 2011/0265392 | A1 * | 11/2011 | Uhl et al. | 52/20 |
| 2012/0011843 | A1 * | 1/2012 | Makinson et al. | 60/527 |

* cited by examiner

VENTING MECHANISM FOR CONTAINERS

CROSS REFERENCE TO RELATED APPLICATIONS

This application is a continuation of U.S. patent application Ser. No. 12/526,360, filed Aug. 7, 2009, which is a continuation of PCT Application No. PCT/US08/56031 filed Mar. 6, 2008, which further claims priority to U.S. Provisional Application Ser. No. 60/893,499 filed Mar. 7, 2007. Additionally, this application is a continuation-in-part of U.S. Provisional Application 60/750,500 filed Dec. 15, 2005 and U.S. patent application Ser. No. 11/611,358, filed Dec. 15, 2006. Both applications are hereby incorporated by reference in their entirety.

STATEMENT REGARDING FEDERALLY SPONSORED RESEARCH OR DEVELOPMENT

This invention was made with U.S. Government support under Contract No. W9223M-06-C-0078 and Contract No. HQ0006-07-C-7609 awarded by the U.S. Army Space & Missile Defense Command to Cornerstone Research Group, Inc. The U.S. Government has certain rights in the invention.

FIELD OF THE INVENTION

Modern munitions are required by federal law to meet insensitive munitions (IM) standards consisting of a series of tests to assess each munition's response to certain external stimuli including bullet/fragment impact as well as slow and fast cook-off scenarios. Solid rocket motors (SRM) inherently pose difficult problems for munitions designers, specifically in terms of reducing the hazards associated with a violent response to inadvertent slow heating during transport or in storage. This dilemma has been particularly difficult for rocket motors containing ammonium perchlorate (AP)-based composite propellants. A great deal of effort and resources have been expended in the last thirty years to develop system-level approaches to meet the challenges focusing on the munitions themselves.

BACKGROUND OF THE INVENTION

The opportunity to attenuate some of these hazards is not limited to the munitions only but has expanded to include their containers as well. The technological advancements in this sector include impact fortification, thermally protective coatings, and thermally-activated panel venting using thermoplastic materials. The next generation of insensitive munitions container technology is emerging to improve performance and provide better reliability to ensure proper venting of munition containers during thermal events without compromising the containers' bullet/fragment impact resistance.

Under normal operating conditions, most containment devices are both effective and relatively safe. These containment devices provide an essential function in storing items and preventing the unwanted spread of the various materials stored in them. These containment devices are especially useful in preventing environmental contamination of explosive or hazardous material. In particular these containment devices are used in modern munitions. In munitions, containment devices provide an essential military capability and are designed to vent allowing the contents to burn, thus preventing an explosion or violent rupture from a build up of pressure.

However, when munitions, such as solid rocket motors (SRMs), are placed under unwanted stimuli, like heat and mechanical shock, dangerous results can occur. Munitions may be triggered to ignition by fire or by impact with bullets or fragments. As a result there is a push to develop a class of munitions that are insensitive munitions (IM). An IM is one that will not detonate under any conditions other than its intended mission. If an IM is struck by fragments from an explosion or hit by a bullet, it should not detonate or explode. Additionally, an IM should not detonate if it is in close proximity to a target that is detonated. In extreme temperatures, insensitive munitions will only burn (without detonation or explosion). The fact that IM will not explode if in close proximity to a detonation and will burn without explosion, allows greater numbers of IM to be packaged, handled, stored, and transported in smaller containers because more items can be stored in these smaller areas and they require shorter distances between storage facilities. However, due to this higher concentration of IM storage, the requirements of IM containers demand higher levels of safety performance. It also allows for cost saving opportunities because more munitions will be able to be stored safely in a smaller area.

As a result of a number of well publicized accidents in recent years involving premature and inadvertent activation of munitions with resultant loss of life among service personnel as well as other damage, there has been an increased emphasis on designing munitions that are safer to store, handle and use. Specifically, in October 2006, in Baghdad, Iraq, a fire erupted in a U.S. ammo dump, setting off a series of blasts due to the detonation of the ammunition that was stored in the facility. This is a prime example of the need for current and future munitions to be IM compliant.

As munition systems are developed or upgraded, they will be required to meet a growing set of specifications for IM compliance. The current technologies that are used to minimize the effects of unintentional stimuli on munitions are insufficient and new IM technologies must be developed to allow IM compliance in future systems. One of the first lines of defense in protection of munitions is the containers that they are stored in during inactive periods. These containers can protect the munitions from bullets and fragments and can serve as a containment system in slow and fast cook-off situations. However, during slow and fast cook-offs of the munition, the container must be capable of sufficiently venting the generated gasses. Current containers are sealed to protect the munition from the outside environment; however, to reach IM compliance, containers must be capable of venting when a set of predetermined conditions are met. SRM cases can also be vented to allow for IM-compliant systems.

In addition to the venting needs of munition containers, venting systems are necessary for various types of containers, such as pressure vessels, grain silos, plumbing systems, fire suppression systems, buildings, and holding tanks. Typically safety panels are incorporated into the roofs or walls of these structures to relieve pressure in the event of an explosion or other sources of high pressure build up in order to relieve pressure to prevent a collapse. However, many of the existing products are based solely on a pressure increase as a stimulus and are not reusable or capable of undergoing non-destructive performance verification testing.

Based on recent incidents with the unintentional detonation of munitions, there has been increased research into the area of creating better, more efficient IM and IM containers. Most of these newer systems rely on passively activated designs to vent their explosive material to the environment before environmental conditions can activate the propellants or explosives.

Current IM container systems, such as those manufactured by Conco, Inc., utilize panels or plugs that melt under thermal stimuli in order to release containment. The panels could be comprised of plastic, rubber, fiberglass, or any other material whose properties allow for containment under normal operating conditions but degrade when exposed to thermal stimuli. However, these panels or plugs can compromise the bullet/fragment impact protection of the vessel in those regions. Additionally, in the event that the melt panel is exposed to a thermal stimulus, the container must be returned to the manufacturer for refurbishment.

Several systems have been developed that use shaped explosive products to create holes in the munitions or propellant containers in order to release containment. However, the explosive products or the impact of a bullet, fragment, or shaped charge jet from typical storage systems may result in a temperature sufficient to ignite the propellants or munitions.

One system utilizing a charge is described in U.S. patent application Ser. No. 11/261,184 filed Oct. 28, 2005 by Skinner. Skinner discloses a device for venting a container housing and energetic material including an installation portion, a charge holder disposed in the insulating portion, and an explosive cutting charge disposed in the charge holder. The device further includes a thermally activated initiation device, and a transfer line coupling the thermally activated initiation device and the explosive cutting charge. When exposed to a temperature at or above a predetermined temperature heat produced deflagration of the thermally activated initiation device initiates deflagration in the transfer line which in turn detonates explosive cutting charges. Upon detonation these explosive cutting charges perforate the container to relieve pressure or avoid buildup of pressure within the case.

In U.S. Pat. No. 6,338,242 issued to Kim et. al on Jan. 15, 2002 a passive ordnance venting system is disclosed. In Kim, the system has an ordnance device, a casing with a vent opening, a dome plug fitted into the formed vent opening and an adapter fitted over the dome plug on the outside of the casing. The adapter connects sufficiently to the casing to retain the dome plug against the formed vent opening for given pressures. The adapter melts at high temperatures and releases the dome plug to reduce the danger of explosion from heat induced over pressurization.

Fuses, charges or plugs do allow venting however; many may be required to achieve adequate venting. Additionally, these venting methods lack durability, and do not increase the function of containers, such as ease of use or access.

In addition, venting systems are necessary for various types of containers, such as pressure vessels, grain silos, and buildings. It is typical to incorporate safety panels into the roofs or walls of buildings such as laboratories, testing facilities, and manufacturing plants in order to relieve pressure in the event of explosions or other sources of high pressure build-up. This is necessary to prevent the structure from collapsing and to minimize the injury to persons inside the structure. A specific application would be the prevention of pressure build up in nuclear reactor containment buildings. Existing blow-out panels, however, are difficult to adjust accurately to the pressure at which a particular panel will blow out.

Commercially available venting systems for building structures are available through suppliers such as Construction Specialties, Inc. and Oseco, Ltd. These systems rely on panels that rupture or hinged panels that require complex calibrated release mechanisms. As such, this added complexity can increase reliability issues. Furthermore, especially with a rupture panel, these existing systems cannot be tested for functionality. Finally, explosion vents are designed to be the weakest part of the external structure, thus can significantly impact the structural integrity of the parent structure. Additionally, they can pose a potential security risk in that intruders can easily access the structure through a rupture type panel.

Shape memory materials were first developed about twenty years ago and have been the subject of commercial development in the last ten years. Shape memory materials derive their name from their inherent ability to return to their original "memorized" shape after undergoing a shape deformation. There are principally two types of shape memory materials, shape memory alloys (SMAs) and shape memory polymers (SMPs).

SMAs and SMPs that have been preformed can be more easily deformed to a desired shape above their glass transition temperature ($T_g$). The SMA and SMP must remain below, or be quenched to below, the $T_g$ while maintained in the desired shape to "lock" in the deformation. Once the deformation is locked in, the SMA, because of its crystalline network, and the SMP, because of its polymer network, cannot return to a relaxed state due to thermal barriers. The SMA and SMP will hold its deformed shape indefinitely until it is heated above its $T_g$, whereupon the SMA and SMP stored mechanical strain is released and the SMA and SMP returns to its preformed state.

There are principally two types of plastics, thermoset resins and thermoplastic resins, each with its own set of unique characteristics. Thermoset resins, for example polyesters, are liquids that react with a catalyst to form a solid, and cannot be returned to their liquid state, and therefore, cannot be reshaped without destroying the polymer networks. Thermoplastic resins, for example PVC, are also liquids that become solids. But unlike thermoset resins, thermoplastics are softened by application of heat or other catalysts. Thermoplastics can be heated, reshaped, heated, and reshaped repeatedly.

SMPs used in the presently disclosed device are unique thermosetting polymers that, unlike traditional thermosetting polymers, can be reshaped and formed to a great extent because of their shape memory nature and will not return to a liquid upon application of heat. Thus by creating a shape memory polymer that is also a thermosetting polymer, designers can utilize the beneficial properties of both thermosetting and thermoplastic resins while eliminating or reducing the unwanted properties. Such polymers are described in U.S. Pat. No. 6,759,481 issued to Tong, on Jul. 6, 2004 which is incorporated herein by reference. Other such thermoset resins are seen in PCT Application No. PCT/US2006/062179, filed by Tong, et al on Dec. 15, 2006; and PCT Application No. PCT/US2005/015685 filed by Tong et al, on May 5, 2005 of which both applications are incorporated herein by reference.

There are three types of SMPs: 1) A partially cured resin, 2) thermoplastics, and 3) fully cured thermoset systems. There are limitations and drawbacks to the first two types of SMP. Partially cured resins continue to cure during operation and change properties with every cycle. Thermoplastic SMP "creeps," which means it gradually "forgets" its memory shape over time. A thorough understanding of the chemical mechanisms involved will allow those of skill in the art to tailor the formulations of SMP to meet specific needs, although generally fully cured thermoset resin systems are preferred in manufacturing.

While SMA and SMP appear to operate similarly on the macro scale, at the molecular scale it is apparent that the method of operation of each is very different. The difference between SMA and SMP at the molecular level is in the linkages between molecules. SMA essentially has fixed length linkages that exist at alternating angles establishing in a zigzag patterned molecular structure. Reshaping is achieved by straightening the angled connections from alternating angles to straight forming a cubic like structure. This method of reshaping SMA material enables bending while limiting any local strains within the SMA materials to less than 8% strain, as the maximum shape memory strain for SMA is 8%. This 8% strain allows for the expansion or contraction of the SMA by only 8%, a strain that is not useful for most industrial applications. Recovery to memory shape is achieved by heating the material above a certain temperature at which point the molecules return to their original zigzag molecular configuration with significant force thereby reestablishing the memory shape. The molecular change in SMA is considered a metallic phase change from Austenite to Martensite which is defined by the two different molecular structures.

SMP has connections between molecules with some slack. When heated these links between connections are easily contorted, stretched and reoriented due to their elastic nature as the SMP behaves like an elastic material when heated; when cooled, the shape is fixed to how it was being held. In the cooled state the material behaves as a typical rigid polymer that was manufactured in that shape. Once heated the material again returns to the elastic state and can be reformed or return to the memory shape with very low force. Unlike SMA which possess two different molecular structures, SMP is either a soft elastomer when heated or a rigid polymer when cooled. Both SMA and SMP can be formulated to adjust the activation temperature for various applications. Critical to the success of the currently claimed device is thermoset SMP which provides an order of magnitude higher stiffness than previous state-of-the-art thermoplastic SMPs.

Shape memory alloys have been used to attempt to solve the IM issue as disclosed in U.S. Pat. No. 6,321,656 issued to Johnson on Nov. 27, 2001. In Johnson a thermally responsive material, such as Nitinol, an SMA, is used to create a latching mechanism which, upon exposure to temperatures in excess of the $T_g$ of the Nitinol changes shape so as to mechanically unlatch the rocket casing section holding the propellant. However, as noted above the shape change is minimal, requiring very large mechanisms to ensure unlatching or thinner SMA as the latching mechanism which may fail due to a lack of structural strength. Additionally, Johnson does not describe or disclose the use of an SMP or SMP composite for use in a venting system for IM.

The term "composite" is commonly used in industry to identify components produced by impregnating a fibrous material with a thermoplastic or thermosetting resin to form laminates or layers. Generally, polymers and polymer composites have the advantages of weight savings, high specific mechanical properties, and good corrosion resistance, which make them indispensable materials in all areas of manufacturing. Because SMPs are resins, they can be used to make composites, which are referred to in this application as SMP composites.

Unlike SMAs, SMPs exhibit a radical change from a normal rigid polymer to a flexible elastic and back on command. SMAs would also have issues with galvanic reactions with other metals which would lead to long term instability. The current supply chain for SMAs is currently not consistent as well. SMP materials offer the stability and availability of a plastic and are more inert than SMAs. Additionally, when made into a composite SMPs offer similar if not identical mechanical properties to that of traditional metals and SMAs in particular. Throughout this disclosure SMP and SMP composites are used interchangeably as each can be replaced by the other depending on the specific design requirements to be met.

Therefore there is a need for a reliable and reusable venting system that can meet the requirements needed to transport and store munitions, vent the munition containers in high temperature environments (cook-off scenarios), yet still maintain bullet/fragment impact resistance requirements. In addition, there is also a need for a more functional venting system for building type structures and other containers.

SUMMARY OF THE INVENTION

The presently disclosed application provides a method and means for ensuring that containers of all types and sizes are vented or purged to atmospheric or environmental conditions upon the exterior of the container reaching a critical temperature. Specifically, the presently disclosed invention integrates shape memory polymer (SMP) based, thermally activated fasteners into the venting systems. The result is a venting system that increases munition safety without compromising the venting effectiveness or the required bullet/fragment impact resistance requirements of the system.

The preferred embodiment of this application is a device that allows pressurized containers to vent to the atmosphere before the contents reach pressures which would cause the container to explode. More preferably the presently disclosed device is used in munitions stored for long periods of time. In addition, disclosed is a venting system that can be used effectively in any container that is susceptible to thermal stimuli. Finally, the disclosed device can be used to prevent overpressurization of volatile liquid and other hazardous containers to prevent similar explosions and loss of life.

Furthermore, the disclosed venting system is capable of receiving a signal from various types of sensors, creating a venting system that is both passive and active. This application would be effective in venting upon numerous stimuli such as air quality, hazardous gases, severe weather warnings, manual alerts, or any other measurable condition.

DETAILED DESCRIPTION OF EXEMPLARY EMBODIMENTS

The disclosed device consists primarily of a vent panel fastened to a container with SMP or SMP composite fastener system that releases upon a thermal stimulus. A fastener system that uses the memory characteristics of SMP to create a releasable fastener system is disclosed in U.S. patent application Ser. No. 11/611,538 filed Dec. 15, 2006 by Hood. The fasteners are comprised of a plurality of geometric shapes that are designed with mating geometries. To engage the fastener system, at least two devices with identical or similar mating geometries are connected to the two parts to be joined together. The SMP is then activated by any number of various mechanisms which will depend on the type of SMP used. Such activation means include, but are not limited to, heat, electrical current, ultraviolet light, water, pH, magnetism, and electromagnetic radiation. Once activated the SMP becomes soft, flexible, and easily manipulated. This allows the mating geometries to be pressed together so that they interlock. Then, the SMP is deactivated by removing the activation means. Upon deactivation, the SMP becomes rigid and the interlocked mating geometries are resistant to shear, pull, and peel forces. To disengage the fastener system, the above process is simply reversed. Once the SMP is flexible, the fasteners are no longer resistant to shear, pull, or peel forces.

These fasteners described by Hood, were originally developed as an efficient means to easily and quickly connect steel armor plating to lightly armored military vehicles. While armor plating is inexpensive, it adds significant weight to light vehicles, causing premature wear on vehicle engines, breaks, and transmissions. The use of SMP fasteners provides the ability to quickly install and remove these heavy plates, thus increasing the functionality and safety of lightly armored vehicles. The Hood application is hereby incorporated by reference in its entirety.

The use of SMP or an SMP composite has been previously disclosed in a venting mechanism, as disclosed by U.S. patent application Ser. No. 12/526,360, filed Aug. 8, 2009, by Traxler. The disclosed containment device primarily consists of a band, ring, or other piece of SMP or SMP composite that, when subject to certain environmental conditions, returns to its memorized shape, releasing containment. This device provides a failsafe mechanism for venting that can be adapted to existing containers with existing plug type venting mechanisms. However, this device offers only limited venting, as such, numerous mechanisms may be required to achieve adequate venting. The Traxler application is hereby incorporated by reference in its entirety.

The description below defines specific embodiments for the disclosed venting system. For the purpose of this description, a container is to include, but is not limited to, the following: buildings, grain silos, pressure vessels, munition containers, plumbing systems, fire suppression systems, and holding tanks.

Figure 1:
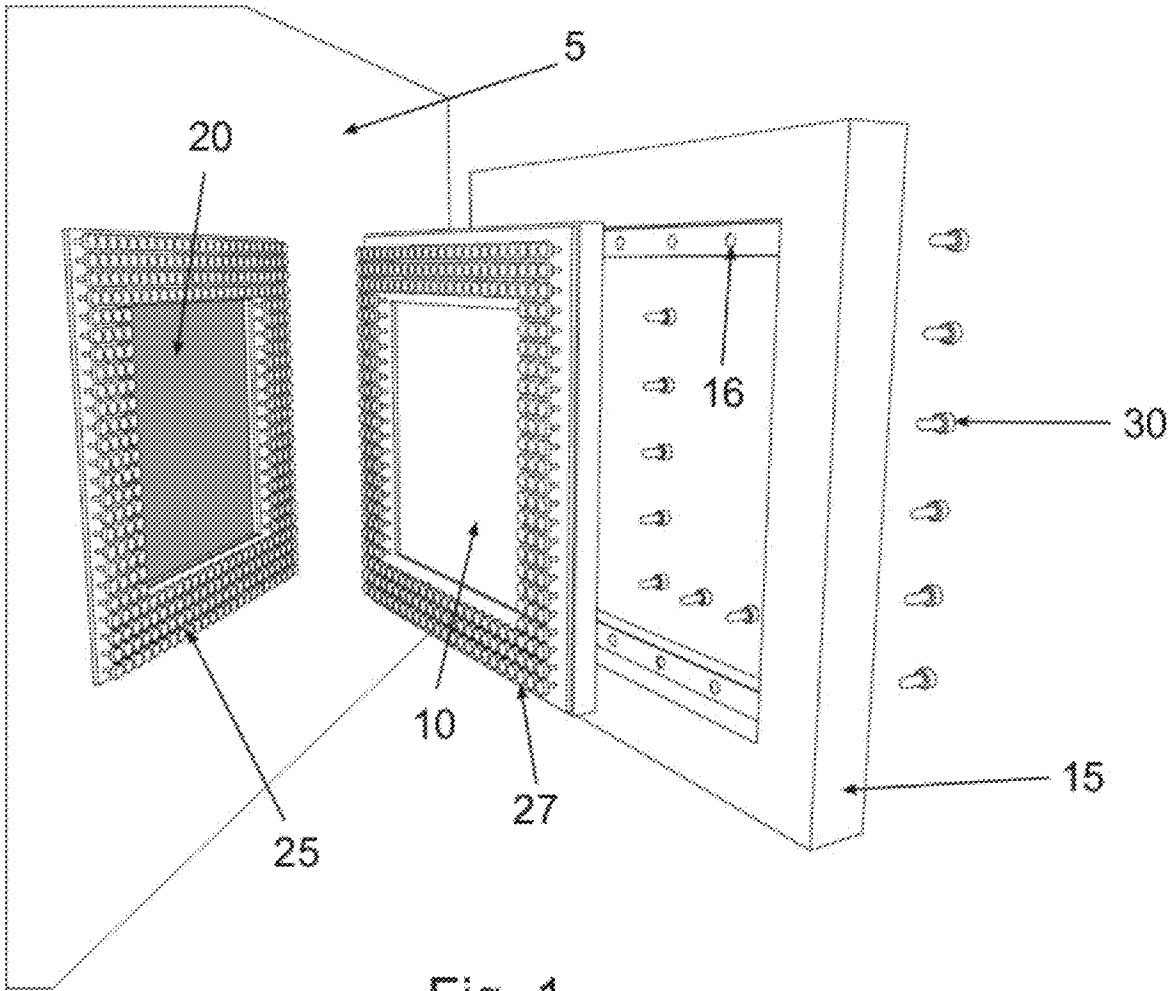
FIG. 1 depicts an exploded view of the disclosed venting system with three major components, the container, vent cover, and frame.

FIG. 1 shows an exploded view of a venting system designed for munition containers, for example. The container, 5, has an opening, 20, around which there is a system of SMP fasteners, 25, that are affixed to the container. The SMP or SMP composite fasteners are adhered to the container using a high-temperature acrylic with glass beads that offers high impact and peel resistance. The particular SMP or SMP composite material and adhesive used will vary depending on the application. A person having skill in the art would be able to determine the appropriate materials that should be used in a particular application.

The vent cover panel, 10, is affixed with SMP fasteners, 27, that have the same mating geometry of the container fasteners, 25. In this embodiment, the vent cover panel, 10, is designed for a munition container and must be able to withstand bullet and fragment impacts, and as such, is comprised of ballistic type steel. However, depending on the application, the vent cover panel, 10, can be constructed of any material, such as mild steel, glass, wood, polycarbonate, aluminum, various composites, or plastic. A person having skill in the art would be able to determine the appropriate material for the specific application. Further, the vent cover can be any shape, but must be at least large enough to be capable of covering the opening and still be able to accommodate enough SMP fasteners to engage with the SMP fasteners on the container.

Finally, there is a frame, 15, that attaches to the vent cover panel, 10, through a series of holes in the vent frame, 16, and bolts, 30. While this embodiment uses bolts, 30, to attach the frame, 15, to the vent cover panel, 10, the means of fastening includes any attachment means, such as latches, quarter turn fasteners, clips, or any similar fasteners. Similarly, depending on the application the frame could be attached using adhesives, welding, nails, or screws for this embodiment, the frame, 15, is comprised of high strength steel as to survive bullet and fragment impact.

Figure 2B:
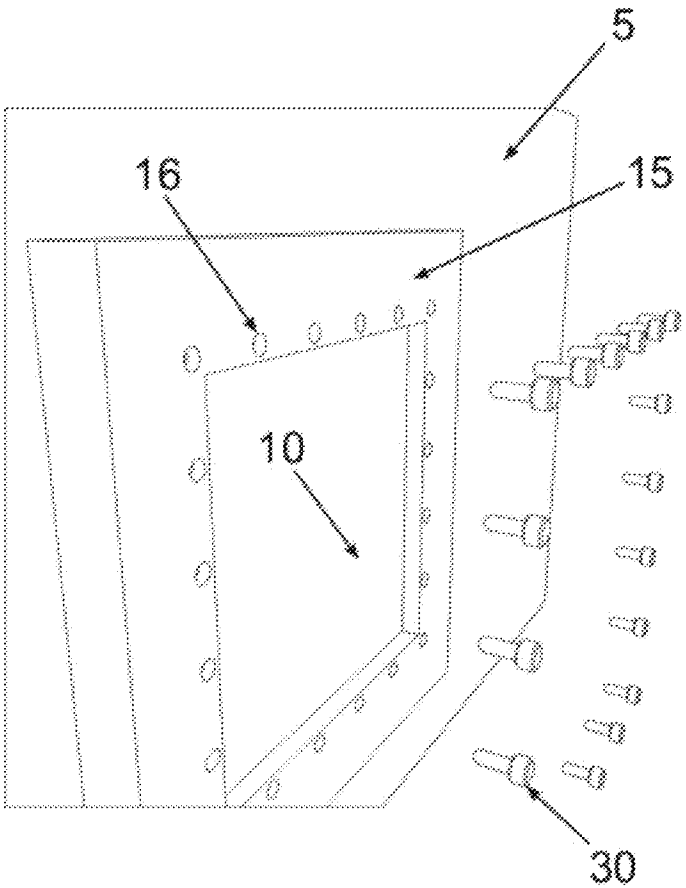
FIG. 2*b* is a second perspective view a partially assembled vent system with the frame placed on the vent cover.
Figure 2A:
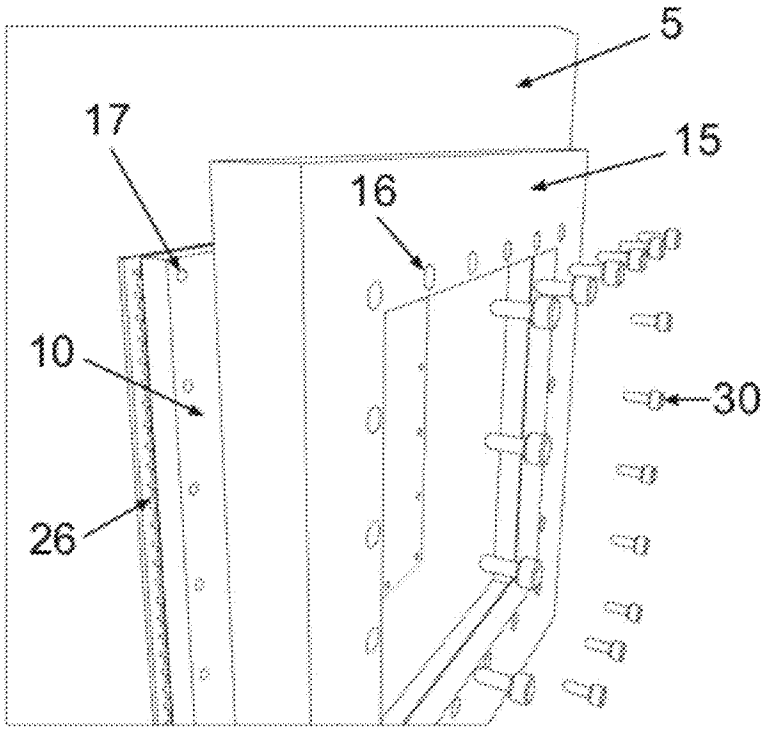
FIG. 2*a* is a perspective view of a partially assembled vent system with the vent cover in place.

FIGS. 2*a* through 2*d* show the venting system assembly process. FIG. 2*a* shows the engaged SMP fasteners, 26, holding the vent panel cover, 10, to the container, 5. In order to engage the SMP fasteners, 25 and 27, of FIG. 1, are activated, becoming elastic and pressed together. Once engaged, the activation means is removed, causing the fasteners to deactivate and become rigid, thus resistant to pull, shear, and peel forces. While this embodiment uses a thermal means of activation, any number of activation means may be used, including, electrical current, ultraviolet light, water, pH, magnetism, and electromagnetic radiation. Bolts, 30, will fasten the vent cover frame to the vent cover panel through a hole, 16, into the threaded vent cover panel hole, 17.

FIG. 2*b* shows the container, 5, with the vent cover frame, 15, in place over the vent cover panel, 10. The bolts, 30, will fasten the vent cover frame, 15, to the vent cover, 10, through the holes, 16.

Figure 2D:
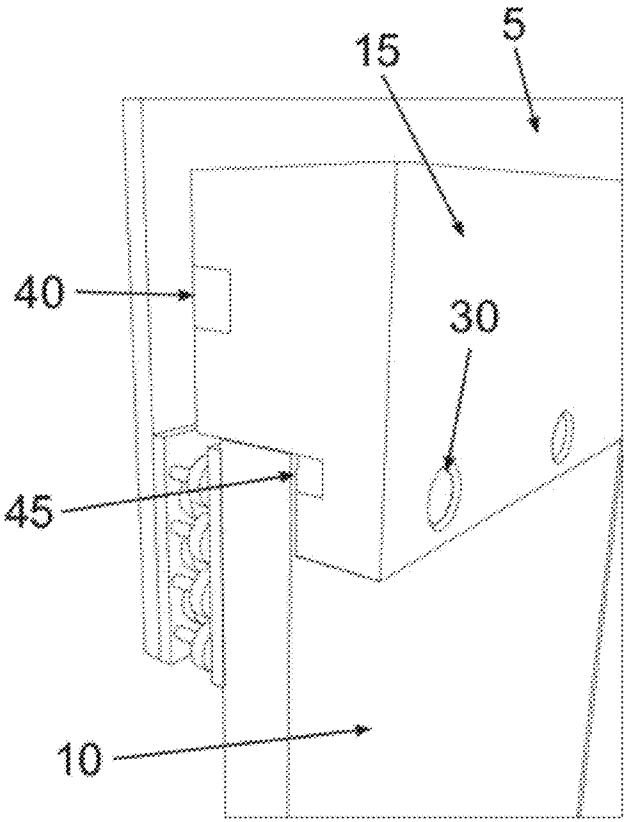
FIG. 2*d* is an isometric cross section of the assembled vent system showing how the container, vent cover, and frame function as a system.
Figure 2C:
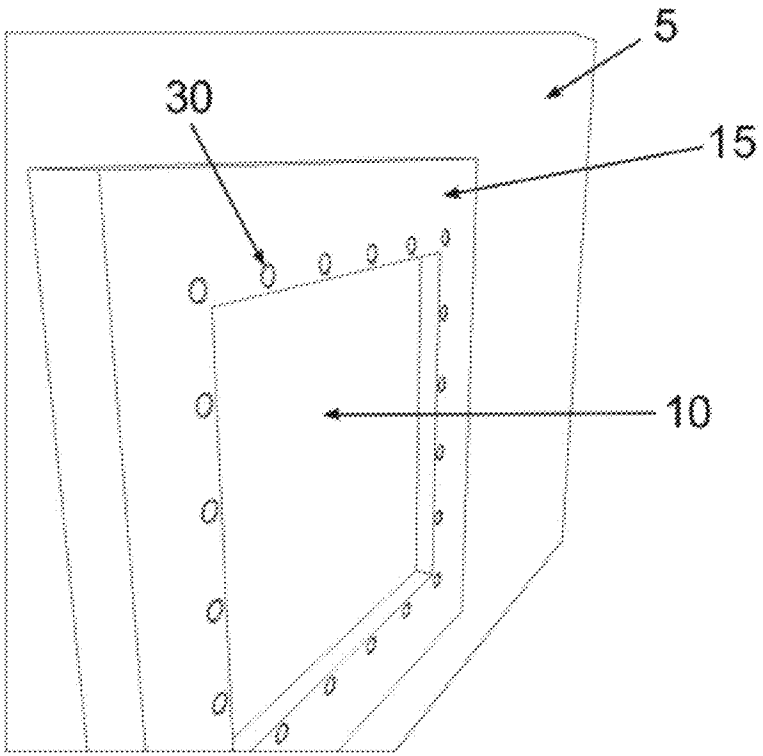
FIG. 2*c* is a perspective view of the assembled vent system such that the container is sealed.

FIG. 2*c* shows the vent cover frame, 15, fastened to the vent cover panel, 10, using bolts, 30. The container, 5, is effectively sealed and capable of maintaining its internal pressure until the appropriate internal or external thermal stimuli occur.

FIG. 2*d* depicts an isometric cross-section of the assembled venting system. In order to form an effective seal, there are two gaskets, 40 and 45. A container gasket, 40, forms a seal between the container, 5, and the vent cover frame, 15. A frame gasket, 45, forms a seal between the frame, 15, and the vent cover panel, 10. As shown, the vent cover frame, 15, and gaskets, 40 and 45, provide a means for sealing, the container, 5, such that an internal pressure or vacuum can be maintained. The vent cover frame, 15, is only attached to the vent cover panel, 10, as such, when a thermal stimulus activates the engaged SMP fasteners, 26, the vent cover panel, 10, and the vent cover frame, 15, will fall away from the container, 5, thus relieving pressure.

Figure 3:
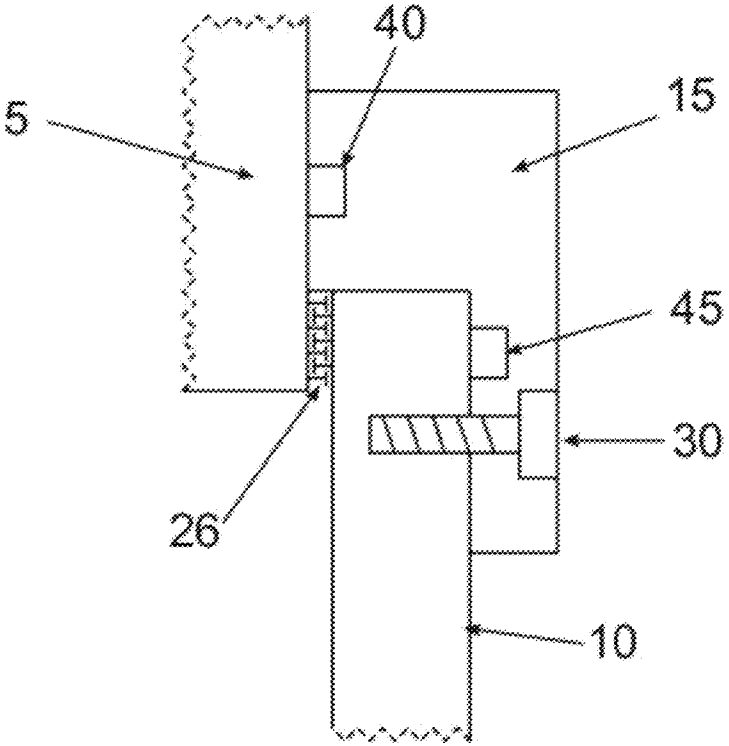
FIG. 3 is a cross section of the assembled vent system with a vent cover and frame with a dual gasket seal.

FIG. 3 shows the cross-section of the assembled venting system shown in FIGS. 1 and 2. The vent cover panel, 10, is attached to the container, 5, by the engaged SMP fasteners, 26. The internal pressure of the container, 5, is maintained by gaskets, 40 and 45, that are fixed between the vent cover frame, 15, and container, 5, and the vent cover frame, 15, and the vent cover panel, 10, by a series of retaining bolts, 30. Being that the vent cover frame, 15, is attached only to the vent cover panel, 10, upon a thermal stimulus internal or external to the container, 5, the engaged SMP fasteners, 26, would become elastic, and the vent cover panel, 10, and vent cover frame, 15, would fall away from the container, 5. This embodiment allows for a high pressure application of the disclosed SMP fastener venting system that is also compliant with bullet and fragment impact resistance requirements.

Figure 4:
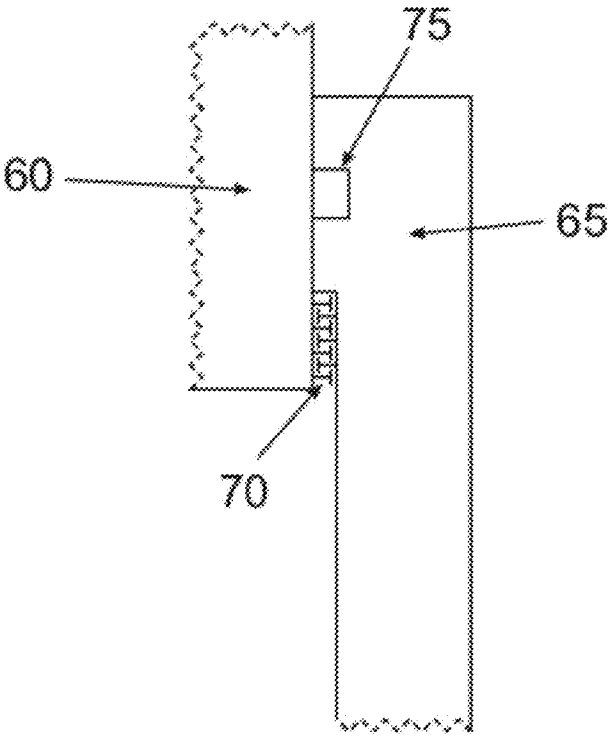
FIG. 4 is a cross section of a second assembled vent system with a single gasket seal.

FIG. 4 depicts the cross-section of another embodiment that comprises a vent cover panel, 65, attached to a container, 60, with engaged SMP fasteners, 70, and a single gasket, 75, to maintain the internal pressure. In this embodiment, the engaged SMP fasteners, 70, are activated, becoming elastic, and then pressed together. When the activation means is removed, the fasteners will return to their memory shape, thus affixing the vent cover, 65, to the container, 60. Once the engaged SMP fasteners, 70, have returned to their memory shape, they will maintain the force necessary for the gasket, 75, to maintain the internal pressure of the container, 60. Of course, depending on the SMP fastener design, a force may need to be applied to the vent cover, 65, while the engaged SMP fasteners, 70, return to their memory shape, in order for the gasket, 75, to form an effective seal. The container, 60, will remain capable of maintaining pressure until a thermal stimulus causes the SMP fasteners, 70, to become elastic and release the vent cover panel, 65, thus relieving containment.

While the means of sealing depicted is a compressed gasket type seal, other applications exist that could be sealed by other means. One such means would be by caulking around the vent panel or frame with a silicone, polyurethane, polysulfide, sylill-terminated-polyether or polyurethane and acrylic sealant. The sealants can form a durable, water tight seal, but at the same time, would still allow the vent panel and/or frame to fall away from the container when the fasteners are activated.

Additionally, while the FIGS. 1-4 depict a venting system wherein the vent cover is fully separable from the container, it is possible to have an embodiment with a hinged end such that the vent cover does not just fall away, but remains intact with the container.

When the SMP fasteners reach their $T_g$ the SMP provides the means for releasing containment, typically through the release of an air-tight seal, of the pressurized vessel so as to prevent ignition or explosion of hazardous material or deflagration of the container. At normal operating temperatures, the SMP or SMP composite fasteners maintain a rigid connection, maintaining an environmental seal to protect the contents of the container. When environmental conditions cause the SMP or SMP composite to exceed its $T_g$, specified by the operating requirements, the SMP becomes elastic, which allows the vent panel to release, causing the container to vent.

In general, the preferred SMP is either a styrene copolymer based SMP as disclosed in U.S. Pat. No. 6,759,481, an epoxy based SMP as disclosed in PCT Application No. PCT/US2006/062179, or a cyanate ester based SMP as disclosed in PCT Application No. PCT/US2005/015685. However, other types of SMPs such as cyanate ester, polyurethane, polyethylene homopolymer, styrene-butadiene, polyisoprene, copolymers of stearyl acrylate and acrylic acid or methyl acrylate, norbornene or dimethaneoctahydronapthalene homopolymers or copolymers, malemide and other shape memory polymers are within the scope of the present device.

The design of the SMP fasteners to be used in the disclosed system will be apparent to those of skill in the art of creating such parts and will vary greatly from container to container depending on which embodiment of the disclosed device is utilized. However, the formulations and chemical makeup of the SMP to be used will vary greatly depending on such factors as normal environmental conditions the mechanism will be exposed to, costs, desired activation temperature or other activation conditions, and the strength of the material needed. The $T_g$ of SMPs can be tailored such that the $T_g$ of the SMP occurs between zero degrees Celsius and two hundred eighy degrees Celsius. The SMP to be used can be selected from the group consisting of styrene based, epoxy based, cyanate ester based, polyurethane based, siloxane based, or other chemicals which can be made into an SMP. Any type of SMP with a sufficiently tailorable and narrow transition band could be used based on the requirements of the actual $T_g$ needed. Of the above, epoxy based SMPs are particularly preferred for their ease of use, manufacture, and low environmental danger posed.

Additionally, while thermal activation of the SMP is the preferred method, there are other methods other than thermal energy to transition the SMP between its hard rigid state to a soft pliable and elastic state and back. Activation means to transition the SMP between its hard rigid state to a soft pliable and elastic state can include, but are not limited to, heat, electromagnetic radiation, electrical current, ultraviolet light, water, pH, and magnetism.

In addition to using pure resin as the mechanism for the venting of a container, the SMP resin can be combined with fibers to create a composite. This is accomplished by curing the resin with the fibers within the resin matrix. SMP combined with traditional composite materials offer high strength to weight ratios, similar to other composites. However, SMP composites offer a unique ability to release stored mechanical energy at a predetermined temperature range. This unique set of mechanical properties makes SMP ideal for implementing IM-compliant lightweight hybrid-composite munition containers.

SMP composites can use a variety of fibrous materials such as carbon nano-fibers, carbon fiber, spandex, chopped fiber, random fiber mat, fabric of any material, continuous fiber, fiberglass, or other type of textile fabric compatible with the SMP resin. Additionally, the strength of the SMP composite can be influenced by the weave of the fabric such as flat weave, two-dimensional weave, or three-dimensional weave patterns. The SMP composites may comprise a composite material formed from at least one layer of fibrous material in combination with a shape memory polymer. In one form, the fibrous material may be embedded within the shape memory polymer or, the fibrous material can be impregnated with the shape memory polymer.

In all of the disclosed embodiments these SMPs or SMP composites may have an integrated heating mechanism to provide for the manual venting of a container. Preferably the heating mechanism consists of thermally conductive fibers or electrical conductors integrated into the SMP or SMP composite, which provide resistance heating when a current is passed through them. As mentioned above, heating the SMP above its $T_g$ will cause the SMP to become soft and pliable or return to its memory shape depending on the level of strain in the SMP prior to reaching its $T_g$; however, other methods are available for activating the SMP including heat, electrical current, ultraviolet light, water, pH, magnetism, and electromagnetic radiation. Application of these stimuli will also cause the SMP to transition between a soft pliable state to a hard rigid state depending on the chemistry used in the manufacture of the SMP resin. It will be apparent to one of skill in this art that there are many different ways, other than resistance heating, to heat the SMP or SMP composites, such as convective and radiation heating, which are hereby included within the scope of the present device.

The inclusion of an integrated heating mechanism allows the venting system to receive a signal from a sensor, thus creating a means to release the venting system in response to any unsafe condition. Thus, in addition to the passive embodiments already discussed, each system can include a control system that, upon receipt of a signal from a sensor, would activate the SMP or SMP composite fasteners, releasing containment.

The disclosed venting system can be tailored to meet shape, size, pressure, and temperature requirements. Furthermore, while the disclosed embodiment releases upon a thermal or electrical stimulus, the disclosed venting system can be further tailored to release upon activation means such as heat, electromagnetic radiation, electrical current, ultraviolet light, water, pH, magnetism, and electromagnetic radiation.

The embodiments already discussed show applicability to military applications for securing munitions yet still having the necessary bullet/fragment impact protection. However, the applicability of this venting system is not limited to munition or military use. This device can be used to vent any container of hazardous or explosive material when environmental conditions create the potential for damage or loss of life. In particular, the oil and chemical industry, gas stations, refineries, storage facilities, and others can use this mechanism as a cheap and effective means of venting.

The thermally activated venting system disclosed could apply to any potentially volatile system that could explode when subjected to adverse thermal stimuli. An example would be a boiling liquid expanding vapor explosion. This type of explosion occurs when a pressure vessel containing a pressurized liquid substantially above its atmospheric boiling point ruptures. When the liquid reaches atmospheric pressure it rapidly expands in violent explosion.

In addition, venting systems are necessary for various types of containers, such as pressure vessels, grain silos, and buildings. It is typical to incorporate safety panels into the roofs or walls of buildings such as laboratories, testing facilities, and manufacturing plants in order to relieve pressure in the event of explosions or other sources of high pressure build up. This is necessary to prevent the structure from collapsing and to minimize the injury to persons inside the structure. A specific application would be the prevention of pressure build up in nuclear reactor containment buildings. Existing blow-out panels, however, are difficult to adjust accurately to the pressure at which a particular panel would blow out.

Furthermore, once a panel blows out, all or part of the panel, or at least the shear bolts would be destroyed and would require replacement. A relief panel based upon the proposed SMP fastening technology would enable panels that were reusable and offered easy reinstallation. This also means that existing types of blow out panels cannot be tested once installed. As the venting system disclosed is reusable, it can be tested and reinstalled as needed.

In addition to venting, these vent covers can be used as access panels yet still providing security. These vent covers can be large enough to allow worker access to larger containers, yet still provide security against fragmentation, bullets, or other projectiles. Additionally, this venting system can provide security against unauthorized access because the activation means is not known by potential intruders, yet still releasable in the event of an emergency.

Additional applications for this thermally actuated technology exist in the realm of fire and explosion safety for buildings and storage systems. Whereas most explosion venting systems rely solely on pressure increases to relieve pressure, the disclosed venting system could be used where any potentially volatile system could explode if subjected to adverse thermal stimuli. Furthermore, in fire suppression systems, a great advantage exists for a thermally actuated fire safety technology over a pressure-actuated one. Pressure-actuated devices must wait until the fire raises the pressure of the building or vessel to the point where the actuator opens. A thermally actuated vent panel, however, will activate as soon as the temperature reaches a certain point and could release a fire extinguishing agent. This means the safety device will activate sooner, possibly reducing injury and damage.

The inclusion of an integrated heating mechanism allows the venting system to receive a signal from a sensor, thus creating a means to actuate the venting system in response to any unsafe condition. Thus, in addition to the passive embodiments already discussed, each system can include a control system that, upon receipt of a signal from a sensor, would activate the SMP or SMP composite fasteners, releasing containment.

Grain silos and manufacturing facilities can experience explosions if a large enough suspension of grain dust is present in the air. The presently disclosed system can be paired with a control system in which a sensor could detect dangerous levels of dust, temperature, or pressure conditions and apply a signal current to the vent panel system causing the structure to vent.

While the activation means could be heat from the fire thermally releasing the vent panel, there could be an active system that would release the extinguishing chemical upon a signal from an alarm or manual alert by an individual. As such, if the appropriate stimulus is not in close enough proximity to activate the fasteners, a remotely located sensor could activate the system. Nevertheless, the SMP fasteners provide back-up in the event of a system failure, in that the thermal activation from the heat of the fire would release the vent cover and the fire-extinguishing agent.

Additionally, the system sensing could provide venting upon any number of dangerous conditions. High levels of carbon monoxide or hazardous gases, a fire alarm, or a weather condition are examples of possible alert signals that could be used to release the vent system.

During severe weather events, such as tornadoes, pressure differentials can place high amounts of force on structures such as building walls or roofs causing damage to the structures. The disclosed venting system can be combined with a controls system designed to identify such a weather condition and release vent panels to reduce or prevent damage to the structure.

As SMP can be tailored to activate upon various stimuli, a water activated SMP or SMP composite venting system can be tailored to release upon conditions such as humidity, moisture, or pH. Additionally, the SMP fastener material and shape can be designed to meet a variety of tensile and shear strength requirements, thus the design can be further tailored to support a specific loading and venting requirement.

The vent panel can be any shape or contoured to fit any surface allowing for even greater flexibility for this venting system in various applications. Furthermore, the venting panel is not limited to a surface, but could comprise a corner of a container, or the entire side of a container. Additionally, the vent panel could have a hinge along one edge, further facilitating the use of this venting system as a primary or alternative access point for a container.

Further, the SMP fastener system venting panel design would not impact the structural integrity of the parent structure and could actually serve as a means for construction. In this embodiment, the panels used to make the sides of the container could be physically attached with the fastener system. This would allow for venting of a container in an IM scenario as well as access to the needed cargo within the container. This would provide a munition box, for example, that would release upon a thermal stimulus and also be able to meet the necessary ballistic impact requirements. As well, this type of container would be able to be disassembled once empty, facilitating more efficient storage and transport of empty containers.

A similar embodiment could be used to make modular containers where multiple containers could be fastened together, thus allowing a container to be sized as necessary, yet still meeting the required venting and ballistic requirements.

Although this device has been described with respect to certain preferred embodiments, it will be appreciated that a wide variety of equivalents may be substituted for those specific elements shown and described herein, all without departing from the spirit and scope of the invention as defined in the appended claims.

What is claimed is:

1. A venting system comprising:

a container having an opening, and a first plurality of active material fasteners surrounding the opening; and a vent cover comprising a frame and a second plurality of active material fasteners disposed on at least one side of the frame, wherein the vent cover is configured to be attached to the container by engagement of the said first plurality of active material fasteners with said second plurality of active material fasteners, and wherein internal pressure in the container is configured to fully separate the vent cover from the opening of the container after activation of said first plurality of active material fasteners and said second plurality of active material fasteners.

2. The venting system of claim 1 wherein said first plurality of active material fasteners are configured to matingly engage said second plurality of active material fasteners.

3. The venting system of claim 2 wherein said first plurality of active material fasteners and said second plurality of active material fasteners are comprised of shape memory polymer or shape memory polymer composite.

4. The venting system of claim 3 wherein said shape memory polymer or shape memory polymer composite is embedded with a thermally or electrically conductive fiber.

5. The venting system of claim 1 wherein said first plurality of active material fasteners and said second plurality of active material fasteners are activated upon receipt of a stimulus.

6. The venting system of claim 5 wherein said first plurality of active material fasteners and said second plurality of active material fasteners are passively activated by a thermal stimulus internal or external to the container.

7. The venting system of claim 1 wherein the venting system further comprises a sealing means, wherein the sealing means comprises bolts or gaskets.

8. The venting system of claim 7 wherein the gaskets are compressed gasket seals.

9. A method comprising:

providing a venting system comprising:

a container having an opening and a first plurality of active material fasteners surrounding the opening;

a vent cover attached over the opening of the container by engagement of the first plurality of active material fasteners and the second plurality of active material fasteners; and activating both said first plurality of active material fasteners and said second plurality of active material fasteners; and detaching the vent cover from the container after activation of said first plurality of active material fasteners and said second plurality of active material fasteners, wherein the vent cover fully separates from the opening of the container due to internal pressure in the container.

10. The method of claim 9 wherein said first plurality of active material fasteners matingly engage said second plurality of active material fasteners.

11. The method of claim 9 wherein said first plurality of active material fasteners and said second plurality of active material fasteners are comprised of shape memory polymer or shape memory polymer composite.

12. The method of claim 11 wherein said shape memory polymer or shape memory polymer composite is embedded with a thermally or electrically conductive fiber.

13. The method of claim 9 wherein said activation of said active material fasteners is achieved by applying heat, or electrical current.

14. The method of claim 9 wherein said deactivation of said first plurality of active material fasteners and said second plurality of said active material fasteners is by cooling or removing electrical current.

15. The venting system of claim 9 wherein said first plurality of active material fasteners and said second plurality of active material fasteners are passively activated by a thermal stimulus internal or external to the container.

16. The method of claim 9 further comprising providing a sealing means between the container and vent cover, wherein the sealing means comprises bolts or gaskets.

17. The method of claim 16 wherein the gaskets are compressed gasket seals.

* * * * *